US007325263B2

(12) United States Patent
Stribling

(10) Patent No.: US 7,325,263 B2
(45) Date of Patent: Feb. 5, 2008

(54) FITTED BED COVERING

(76) Inventor: Hal D. Stribling, 301 W. South St., Union, SC (US) 29379

( * ) Notice: Subject to any disclaimer, the term of this patent is extended or adjusted under 35 U.S.C. 154(b) by 0 days.

(21) Appl. No.: 11/438,516

(22) Filed: May 22, 2006

(65) Prior Publication Data

US 2007/0266495 A1 Nov. 22, 2007

(51) Int. Cl.
*A47G 9/02* (2006.01)

(52) U.S. Cl. ..... 5/497; 5/485; 5/499

(58) Field of Classification Search ..... 5/497, 5/499, 485, 495, 482
See application file for complete search history.

(56) References Cited

U.S. PATENT DOCUMENTS

| | | | | | |
|---|---|---|---|---|---|
| 924,733 | A | * | 6/1909 | Carswell, Sr. | 5/497 |
| 1,327,824 | A | * | 1/1920 | Holland | 5/497 |
| 1,732,663 | A | * | 10/1929 | Schimmel | 5/499 |
| 1,865,329 | A | * | 6/1932 | McHorter | 5/497 |
| 1,959,920 | A | * | 5/1934 | Kaiser | 5/498 |
| 2,151,375 | A | * | 3/1939 | De Voe | 5/497 |
| 2,870,463 | A | * | 1/1959 | Hoppe | 5/494 |
| 2,942,280 | A | | 6/1960 | May | 5/497 |
| 3,144,666 | A | | 8/1964 | Clark | 5/493 |
| 3,258,789 | A | * | 7/1966 | Banks | 5/485 |
| 3,654,646 | A | * | 4/1972 | McMahon, Jr. | 5/497 |
| 3,824,640 | A | * | 7/1974 | Golden | 5/485 |
| 4,045,831 | A | * | 9/1977 | Clark | 5/497 |
| 4,308,626 | A | | 1/1982 | Weiss | 5/485 |
| 4,338,693 | A | | 7/1982 | Vitale | 5/500 |
| 4,437,704 | A | | 3/1984 | Hovsepians | 297/440.14 |
| 4,517,693 | A | * | 5/1985 | Viesturs | 5/681 |
| 4,651,371 | A | | 3/1987 | Hahn | 5/497 |
| 4,672,702 | A | | 6/1987 | Isham | 5/497 |
| 4,686,725 | A | | 8/1987 | Mitchell | 5/692 |
| 4,723,331 | A | | 2/1988 | Weiss | 5/497 |
| 4,809,375 | A | | 3/1989 | Bull | 5/722 |
| 4,809,376 | A | * | 3/1989 | Boldra | 5/497 |
| 4,825,489 | A | | 5/1989 | Ross | 5/497 |
| 4,841,588 | A | | 6/1989 | Harbin et al. | 5/494 |
| 4,862,538 | A | | 9/1989 | Spann et al. | 5/730 |
| 4,862,541 | A | | 9/1989 | Hutton et al. | 5/496 |
| 4,955,095 | A | | 9/1990 | Gerrick | 5/691 |
| 4,962,546 | A | | 10/1990 | Vitale | 5/497 |
| 4,979,251 | A | | 12/1990 | Lazar | 5/496 |
| 4,980,941 | A | | 1/1991 | Johnson, III | 5/497 |
| 5,027,460 | A | | 7/1991 | Honig | 5/497 |
| 5,029,353 | A | | 7/1991 | Kimball et al. | 5/497 |
| 5,033,139 | A | | 7/1991 | Renfro | 5/658 |
| 5,056,441 | A | | 10/1991 | Seago | 112/2.1 |
| 5,127,115 | A | | 7/1992 | Williams et al. | 5/497 |
| 5,142,718 | A | | 9/1992 | Anderson et al. | 5/497 |
| 5,165,128 | A | | 11/1992 | Honig | 5/497 |
| 5,177,821 | A | | 1/1993 | Kawtoski | 5/497 |
| 5,189,744 | A | * | 3/1993 | Roberts | 5/497 |
| 5,247,893 | A | | 9/1993 | Zafiroglu | 112/475.08 |
| 5,249,322 | A | | 10/1993 | Seago | 5/499 |

(Continued)

FOREIGN PATENT DOCUMENTS

EP 1 295 550 A1 3/2003

*Primary Examiner*—Robert G. Santos

(57) ABSTRACT

A fitted bed covering for a mattress is provided having pockets at either end, formed by elastic panels attached to the underside of the sheet. The fitted bed covering is installed on a mattress by inserting opposite ends of the mattress into the elastic pockets.

20 Claims, 4 Drawing Sheets

U.S. PATENT DOCUMENTS

| | | | | | |
|---|---|---|---|---|---|
| 5,287,574 | A | | 2/1994 | Kardell et al. | 5/499 |
| 5,465,440 | A | | 11/1995 | Heptner | 5/497 |
| 5,491,853 | A | * | 2/1996 | Turnbull | 5/497 |
| 5,515,799 | A | | 5/1996 | Heptner | 112/475.08 |
| 5,523,144 | A | | 6/1996 | Dye, Jr. | 428/158 |
| 5,542,137 | A | | 8/1996 | Byfield | 5/500 |
| 5,603,132 | A | | 2/1997 | Zafiroglu | 5/497 |
| 5,615,425 | A | * | 4/1997 | Corente | 5/81.1 T |
| 5,642,540 | A | | 7/1997 | Culver et al. | 5/499 |
| 5,642,547 | A | | 7/1997 | Hutton et al. | 5/692 |
| 5,729,847 | A | | 3/1998 | Allardice | 5/502 |
| 5,809,593 | A | | 9/1998 | Edwards | 5/497 |
| 5,970,543 | A | * | 10/1999 | Barreca et al. | 5/497 |
| 5,970,544 | A | | 10/1999 | Kardell | 5/499 |
| 5,996,147 | A | * | 12/1999 | Trimble | 5/482 |
| 6,061,851 | A | | 5/2000 | Crowell | 5/497 |
| 6,067,677 | A | | 5/2000 | Reen et al. | 5/499 |
| 6,108,836 | A | | 8/2000 | Keen, III | 5/497 |
| 6,122,782 | A | | 9/2000 | Chedid | 5/495 |
| 6,134,730 | A | | 10/2000 | Evanson | 5/482 |
| 6,199,231 | B1 | | 3/2001 | Zafiroglu | 5/497 |
| 6,226,815 | B1 | | 5/2001 | Mink et al. | 5/497 |
| 6,243,895 | B1 | | 6/2001 | Amin | 5/498 |
| 6,253,398 | B1 | | 7/2001 | Yim | 5/499 |
| 6,272,701 | B1 | | 8/2001 | Zafiroglu | 5/499 |
| 6,286,163 | B1 | | 9/2001 | Trimble | 5/485 |
| 6,301,729 | B1 | | 10/2001 | Hall | 5/494 |
| 6,353,947 | B1 | | 3/2002 | McCain et al. | 5/500 |
| 6,393,640 | B1 | | 5/2002 | Dalis | 5/497 |
| 6,447,874 | B2 | | 9/2002 | Antinori et al. | 428/102 |
| 6,496,992 | B2 | | 12/2002 | Saparow | 5/482 |
| 6,499,157 | B1 | | 12/2002 | McCain et al. | 5/497 |
| 6,502,258 | B1 | * | 1/2003 | Mitchell | 5/497 |
| 6,539,565 | B1 | * | 4/2003 | Trimble | 5/485 |
| 6,618,880 | B1 | | 9/2003 | Chase | 5/500 |
| 6,634,042 | B2 | | 10/2003 | Blossman | 5/499 |
| 6,842,921 | B1 | | 1/2005 | Tsiarkezos et al. | 5/497 |
| 6,883,193 | B2 | | 4/2005 | Brooks et al. | 5/497 |
| 6,971,130 | B2 | | 12/2005 | Chase | 5/500 |
| 6,988,283 | B2 | * | 1/2006 | Griffin | 5/497 |
| 2004/0068794 | A1 | | 4/2004 | Wootten | 5/497 |
| 2005/0071923 | A1 | * | 4/2005 | Griffin | 5/497 |
| 2005/0193490 | A1 | | 9/2005 | Macdonald | 5/500 |
| 2007/0240262 | A1 | * | 10/2007 | Johnson et al. | 5/485 |

* cited by examiner

FITTED BED COVERING

BACKGROUND OF THE INVENTION

The present invention relates to the field of fitted bed coverings, in particular, to a fitted sheet or fitted mattress pad for covering a mattress. The fitted bed covering is secured by panels of an elastic fabric or other elastic sheet of material, attached to the underside of the fitted bed covering to form pockets, which fit over opposite ends of a mattress.

Typically, the top portion of a fitted sheet is woven from an inelastic fiber or yarn, such as cotton, polyester or a cotton/polyester blend. The corners of the sheet are cut, and the sides and ends of the sheet are sewn at each corner to conform to the box shape of a bed mattress. The sides and ends create a band around the fitted sheet and may be referred to as a "skirt." An elastic cord or band is sewn into the outer edge of the skirt, to hold the sheet in place.

It has been suggested to employ an elastic fabric or yarns in the skirt of the fitted sheet. For example, fitted sheets having a skirt constructed of elastic fabric or yarns are disclosed in the following U.S. Pat. Nos. 2,942,280; 4,962,546; 5,056,441; 5,127,115; and 5,603,132.

Fitted sheets having a skirt constructed with sections of elastic fabric and inelastic fabric may be found in the following United States patents and applications: U.S. Pat. Nos. 4,672,702; 4,980,941; 5,029,353; 5,287,574; 6,618,880 B1; 6,842,921 B1; US 2004/0068794 A1; and US 2005; 0193490 A1.

Elastic fabric has been employed in securing mattress pads, bedspreads and blankets, to a mattress. U.S. Pat. No. 6,393,640 discloses a gel-filled mattress pad having a pocket at one end, to prevent the pad from slipping when the mattress is in a raised position. The pocket is formed by a bottom wall, back wall and two side walls, which are sewn together and attached to the mattress pad. The aforementioned bottom, back and side walls components may be made of elastic fabric. U.S. Pat. No. 3,144,666 discloses a bedspread held in place by elastic bands. In U.S. Pat. No. 4,841,588, a blanket is held in place by a band encircling the sides of a mattress, wherein the band contains an elastic panel.

There are a number of shortcomings with the prior art fitted bed coverings. For most of the constructions, several pieces of fabric must be cut and sewn together, which increases manufacturing complexity, and thus increases costs. For many of the designs, pieces of the sheet are cut-out, to avoid overlap when the sides and ends are folded and sewn together. The cut-out pieces become scrap. Further, when elastic is used in the skirt of a fitted sheet or mattress pad, substantial force may be required to stretch the fitted sheet over the sides of a mattress. Individuals with back problems or those that change bedding for a living, such as maids and hospital orderlies, may experience back injury from "wrestling" such sheets into place. Additionally, since most fitted sheet designs have a skirt that protrudes perpendicularly from the body of the sheet, it is difficult to fold the fitted sheets compactly, for shipping and storage.

SUMMARY OF THE INVENTION

The fitted bed covering of the present invention is designed to cover a mattress. The mattress may be characterized as having (i) a top surface, also referred to as the sleeping surface; (ii) a bottom surface, typically resting on box springs, slats or other support; (iii) and three dimensions, referred to as a length, width and thickness. The mattress has a head, a foot and two opposite sides extending from the head to the foot, all of which are referred to generally herein as "ends" of the mattress.

The fitted bed covering is made of an upper sheet of fabric that overlays the sleeping surface of the mattress. The upper sheet may be larger in area than the sleeping surface of the mattress, to allow the upper sheet to drape over the edges of the top surface of the mattress. The drape may extend the thickness of the mattress or to a desired distance beyond the mattress thickness. The upper sheet may be large enough to drape over two opposite ends of the mattress, or may be sized to drape all around the mattress. For aesthetics, it is generally not necessary to provide the fitted mattress pad embodiment of the invention with an upper sheet large enough to drape over the sides of the mattress, since the mattress pad and sides of the mattress can be covered with a sheet.

In one embodiment of the invention, the upper sheet is rectangular, thereby minimizing scrap and simplifying cutting and sewing.

The upper sheet is at least large enough to incorporate a rectangular area that is substantially the size of the sleeping surface of the mattress. In other words, (i) the upper sheet is substantially the same size as the sleeping surface of the mattress, or (ii) it is possible to delineate a rectangular area of the upper sheet that is substantially the same size as the sleeping surface of the mattress, out of an upper sheet that is larger than the sleeping surface of the mattress.

The fitted bed covering is held in place on the mattress by panels made of an elastic fabric or sheet, which are attached to the underside of the upper sheet. Typically, two panels are attached to the underside of the upper sheet, positioned to overlay opposite ends of the rectangular area. Each of the panels is attached to the upper sheet on three sides, to form a pocket, with the pocket being open toward the center of the rectangular area of the upper sheet. The dimensions of the pocket are sufficient to allow an end of the mattress to be inserted therein, with the elastic fabric panel stretching as necessary, to accommodate the mattress. The panel may be stretched, prior to being attached to the upper sheet. Although this will cause the upper sheet to pucker when the tension is released, the fabric will exert greater compressive force when the end of the mattress is inserted into a pocket of the fitted bed covering.

In one embodiment, the fitted bed covering is provided with first and second pockets at the head and foot of the rectangular area of the upper sheet, and the head and foot of a mattress are inserted in the pockets, respectively. Alternatively, the first and second pockets are positioned along the sides, rather than at the head and foot of the rectangular area of the upper sheet, and the sides of the mattress are inserted in the pockets. It is also possible to provide a mattress covered with a fitted mattress pad and a fitted sheet, which are both fitted bed coverings according to the present invention. For example, a fitted mattress pad having pockets on the sides may engage the sides of a mattress, and a fitted sheet having pockets and the head and foot may engage the head and foot of the mattress, or vice versa.

In another embodiment of the invention, the fitted bed covering is provided with four panels of elastic fabric that are attached to the underside of the upper sheet at both (i) the head and foot of the upper sheet, and (ii) the sides of the upper sheet, to form four pockets, opening toward the center of the rectangular area. The pockets overlap in the corners of the rectangular area of the upper sheet, as discussed in greater detail below. Some advantages of providing four elastic panels, especially when the bed covering is a fitted sheet, is that the upper sheet need not be larger than the rectangular area needed to cover the sleeping surface of the mattress, i.e. the upper sheet need not be large enough to drape over the sides of the mattress, since the elastic panels will cover all of the sides of the mattress.

The panel may be attached to the upper sheet by sewing or by an adhesive, for example, a hot-melt adhesive, referred to generally as seams. The seams used to attach a panel to the upper sheet need not form 90° angles, relative to each other, and it is possible to form the pocket with seams having arcuate segments or with arcuate corners. Further, the seams need not be continuous, for the operation of the invention. Nevertheless, for aesthetic reasons, it may be desirable that the seams forming the pocket be substantially continuous.

The panel is planar, although it may be constructed of multiple sections. For example, the panel may alternate along its length from a first elastic section, attached to an inelastic section, attached to a second elastic section. Such a panel will meet the requirements of the invention for being "elastic" if the pocket formed by the panel and the upper sheet will stretch to accommodate the end of a mattress and provide compressive force or tension to restrict shifting of the fitted bed covering relative to the surface of the mattress. In one embodiment of the invention, each of the panels is a single piece of elastic fabric.

The advantages of using a planar panel, especially a single piece of fabric, is that the manufacturing steps are minimized—it is no longer necessary to form the pocket from multiple pieces of fabric, for example by sewing together back, sides and bottom pieces, to create a "box shape" construction. Further, the panel may directly overlay the upper sheet, lying flat on the upper sheet, that is, the upper sheet and panel represent parallel planes in contact with each other, thereby making it easy to fold the fitted bed covering flat for packaging or storage, when not in use. Yet another advantage of the foregoing structure is that when an end of the mattress is inserted into a pocket, the panel will be significantly stretched to envelop the mattress, which ensures that the compressive force of the elastic fibers or yarns in the panel will hold the fitted bed covering firmly in place.

It can be understood that an elastic panel capable of conforming itself to the shape of the mattress, when the fitted bed covering is in use, may be provided. For example, a fabric panel having bi-axial elasticity will readily conform to the shape of the mattress, when the panel is used to form a pocket in which an end of the mattress is inserted. In the present invention, the term "biaxial elasticity" means a material that is elastic in perpendicular directions, provided that the elasticity in each direction need not be equal. A further advantage of employing a fabric panel having bi-axial elasticity is that when the fitted bed covering is installed on a mattress, the panels at either end of the upper sheet (or at either side of the upper sheet) will pull the upper sheet taut in all four directions, that is, from end to end and from side to side.

The panel is positioned to overlay a portion of the rectangular area, delineated as a "strip" of the rectangular area, having a length extending along a first side of the rectangular area. The ends of the strip abut the sides of the rectangular area that are perpendicular to the first side. The width of the strip, measured perpendicular from the first side of the rectangular area, is (i) greater than the thickness of the mattress to be covered, and (ii) less than one-half of the distance from the first side of the rectangular area to a second side of the rectangular area, opposite the first side. In one embodiment, the width of the strip is less than one-fourth of the distance from the first side of the rectangular area to the second side of the rectangular area. The width of the strip may be tailored to optimize the ease of installation of the fitted bed covering on a mattress and to ensure that the upper sheet is held firmly in place.

In one embodiment, the panel overlays the strip and has substantially the same size and shape as the strip. Accordingly, the seams that attach the panel to the upper sheet extend along the first side of the rectangular area and along both ends of the strip, perpendicular to the first side of the rectangular area. The side of the panel opposite the first side of the rectangular area is open, that is, not attached to the upper sheet, thereby creating a pocket.

It may be understood that the size and shape of the panel may be varied and that it need not correspond exactly to the shape of the strip, which it overlays. For example, the length of the panel may be shorter than the strip, which may have the advantage of greater stretch of the panel. For aesthetic purposes, when the length of the panel corresponds to the length of the strip, the corners of the fitted bed covering will not pucker, and the rectangular area of the upper sheet will be pulled taut over the sleeping surface of the mattress.

A second panel is attached to the underside of the upper sheet according to the method described for the first panel, with the exception that the second panel is installed at an opposite end of the rectangular area from the first panel. Thus, the second panel overlays a second strip delineated in the rectangular area, which extends along a second side of the rectangular area, opposite the first side. The second pocket that is formed by the second panel opens towards the center of the rectangular area and towards the open side of the first pocket formed by the first panel.

The pockets may have a depth (measured perpendicularly from the opening of the pocket to the side of the rectangular area where the pocket is seamed) of from 4 inches to 36 inches. Accordingly, the fitted bed covering has the advantage of versatility in being able to accommodate a wide range of mattress thicknesses. In one embodiment, the depth of the pocket is from 12 inches to 30 inches, and accommodates a majority of commercial mattresses.

The upper sheet may be constructed of a woven, knitted or non-woven fabric, or it may be a plastic or rubber sheet. When the fitted bed covering is a mattress pad, the upper sheet may be quilted. For example, a fitted mattress pad having a non-woven padding quilted between two pieces of fabric may constitute the upper sheet. The present invention is particularly useful with conventional, woven fabric used for bed sheets. By way of example, the upper sheet may be a woven fabric of spun yarn or multifilament yarn. The fiber may be virtually any natural or synthetic fiber of combinations thereof. By way of example, the fiber may be cotton, polyester or a cotton/polyester blend. In one embodiment, the upper sheet is inelastic. In one embodiment of the invention, the upper sheet fabric is pre-shrunk, before the elastic panels are attached.

The panels are constructed out of an elastic fabric or sheet, that is, a material capable of being significantly stretched and returning to its original shape. In one embodiment, the elastic fabric or sheet can be stretched over 100% in at least one direction, and will recover to its original length. The panel may be a woven, knitted or non-woven fabric or may be an elastomeric sheet. By way of example, the fabric may be a knitted or stitch-bonded fabric. An elastic fiber or combination of elastic and non-elastic fibers may be used to construct a suitable fabric. By way of example, the panel fabric may be constructed of spandex fiber. In one embodiment of the invention, the panel has bi-axial elasticity.

DETAILED DESCRIPTION OF THE INVENTION

Without limiting the scope of the invention, the preferred embodiments and features are hereinafter set forth. All of the United States patents, which are cited in the specification, are hereby incorporated by reference. The following detailed description refers to the fitted sheet embodiment of the fitted bed covering. It may be understood that the structure of the fitted mattress pad embodiment of the invention will be the same, except for the materials of construction of the upper sheet, that is, the upper sheet of the mattress pad will be padded.

Figure 1:
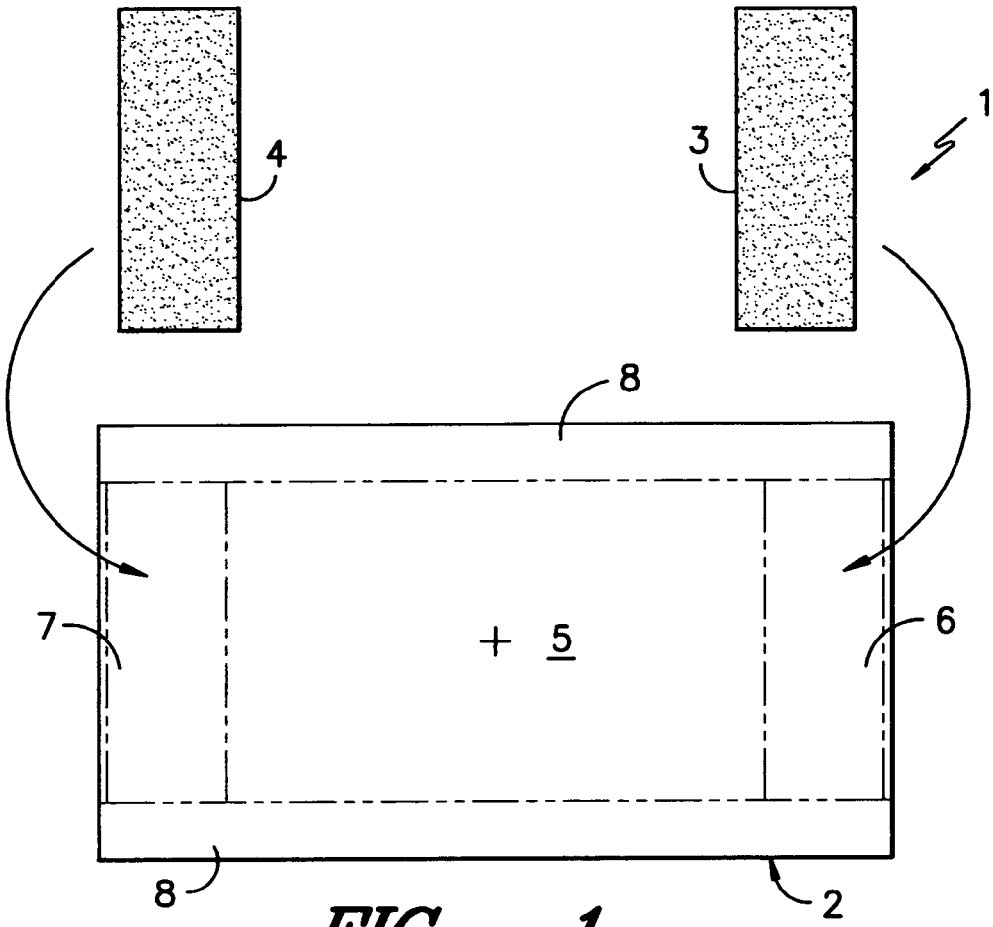
FIG. 1 is an exploded view of the underside of the fitted bed covering.

FIG. 1 is an exploded view of the underside of fitted sheet 1, which is comprised of upper sheet 2 and panels 3 and 4. Upper sheet 2 is delineated by rectangular area 5, which includes and is delineated by strips 6 and 7. Upper sheet 2 is wider than rectangular area 5, and extends a distance equivalent to or greater than the thickness of a mattress to be covered, identified as drape 8.

Figure 2:
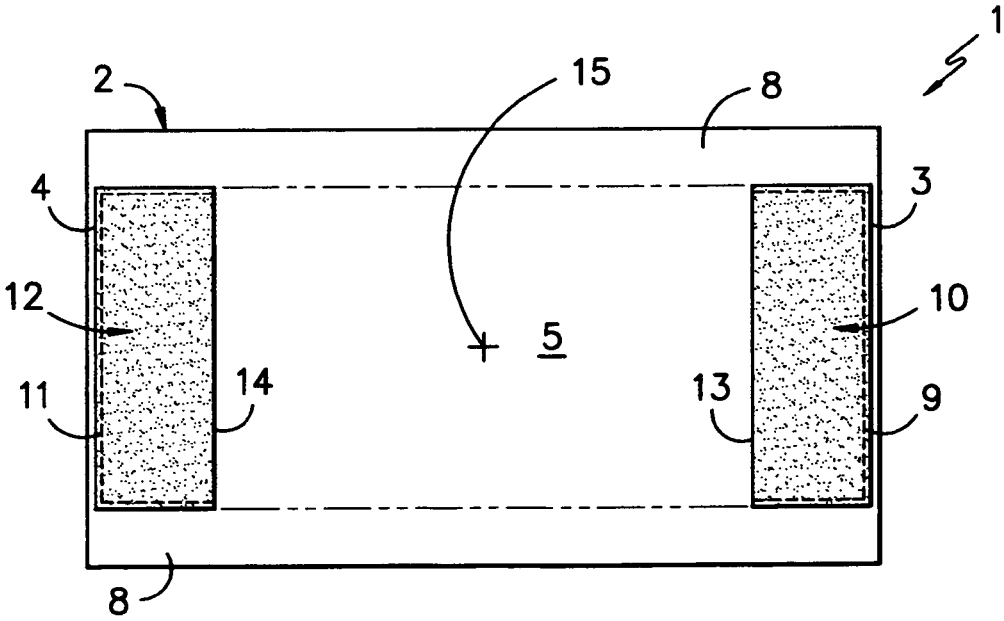
FIG. 2 is a view of the underside of the assembled fitted bed covering.

FIG. 2 is a view of the underside of assembled fitted sheet 2. Panel 3 is attached to upper sheet 2 at seams 9, to create pocket 10. Likewise, panel 4 is attached to upper sheet 2 at seams 11, to create pocket 12. Pockets 10 and 12 have openings 13 and 14, respectively, which open towards the center 15 of upper sheet 2, corresponding to the center of rectangular area 5.

Figure 3:
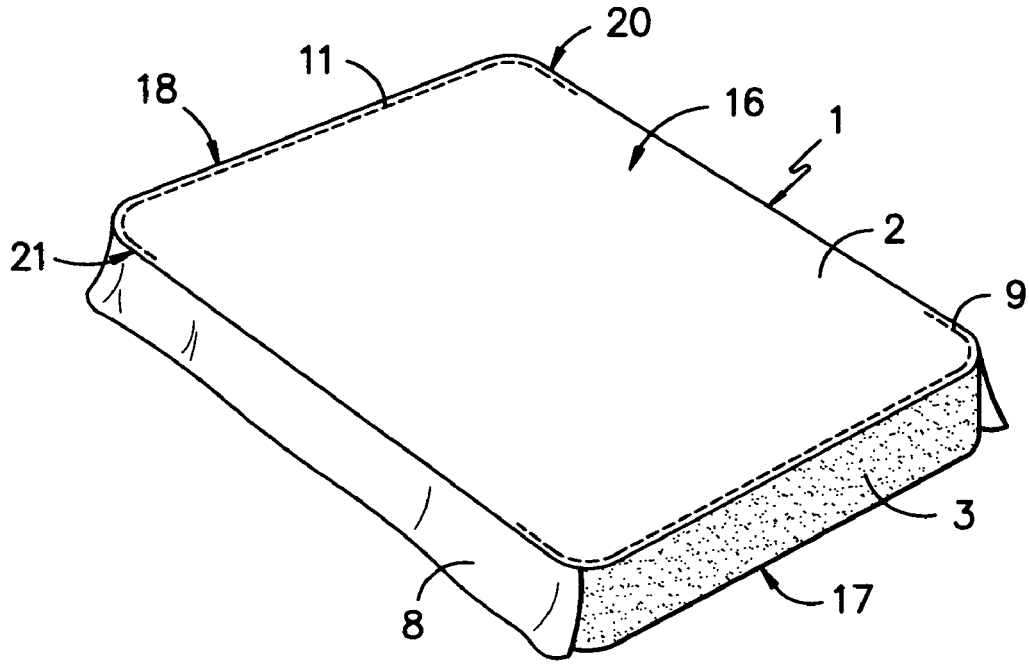
FIG. 3 is a perspective view of upper side of a mattress with the fitted bed covering installed.
Figure 4:
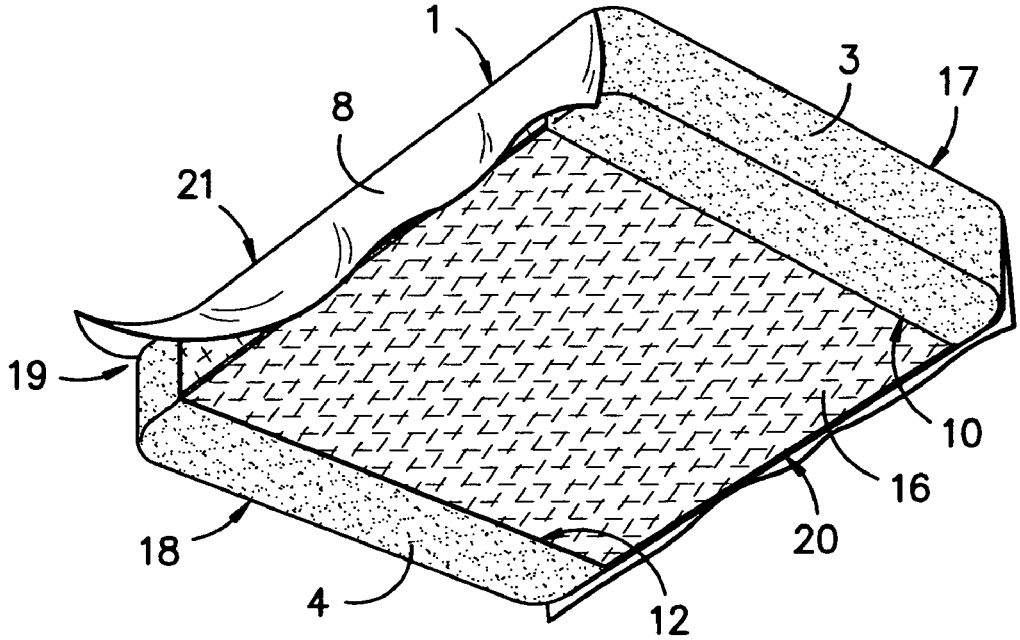
FIG. 4 is a perspective view of the underside of a mattress with the fitted bed covering installed.

FIGS. 3 and 4 are perspective views from the top and bottom, respectively, of mattress 16, having fitted sheet 1 installed thereon. Panel 3 is shown stretched over mattress 16, when the head 17 of the mattress is inserted in pocket 10. Foot 18 of mattress 16 has been inserted in pocket 12, and panel 4 is stretched over foot 18.

Referring to FIG. 4, drape 8 has been lifted in the drawing at corner 19, to reveal the underlying relationship between pocket 12 and mattress 16. It can be seen that panel 4 pulls upper sheet 2 taut across the sleeping surface of mattress 16, both from head 17 to foot 18 and from sides 20 and 21.

Figure 5:
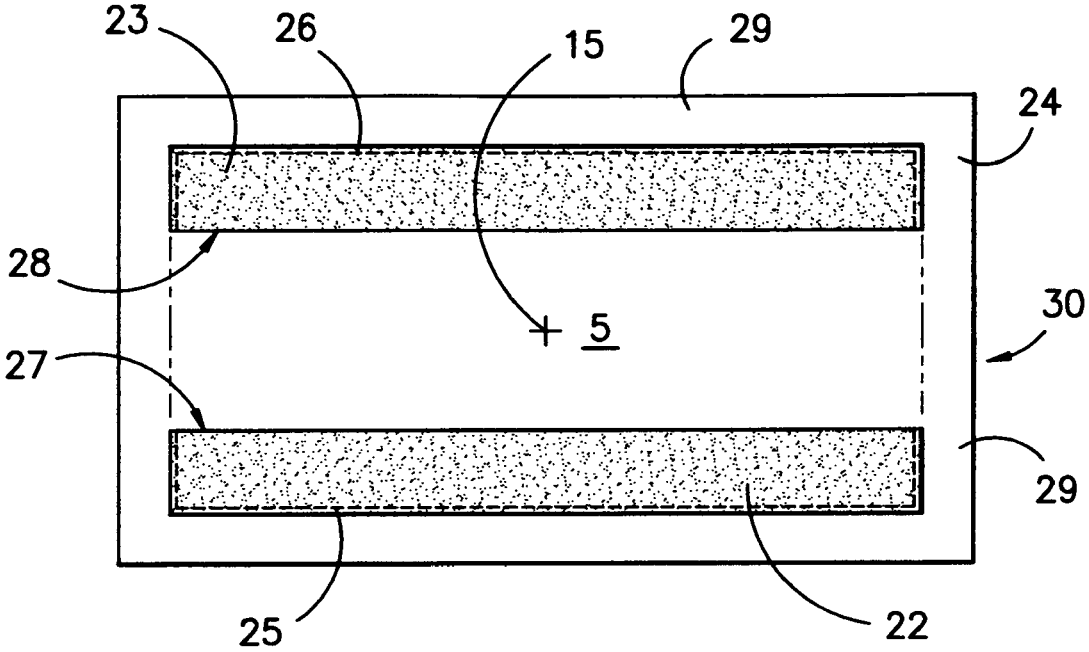
FIG. 5 is a view of the underside of the assembled fitted bed covering, showing the panels installed and pockets formed on either side of the upper sheet.

FIG. 5 shows an embodiment of the invention having panels 22 and 23 attached lengthwise to upper sheet 24, along the insides of rectangular area 5. Panels 22 and 23 are attached by seams 25 and 26, respectively, to create pockets 27 and 28. FIG. 5 shows an embodiment of the present invention wherein upper sheet 2 extends on all sides of rectangular area 5 to create drape 29.

Figure 6:
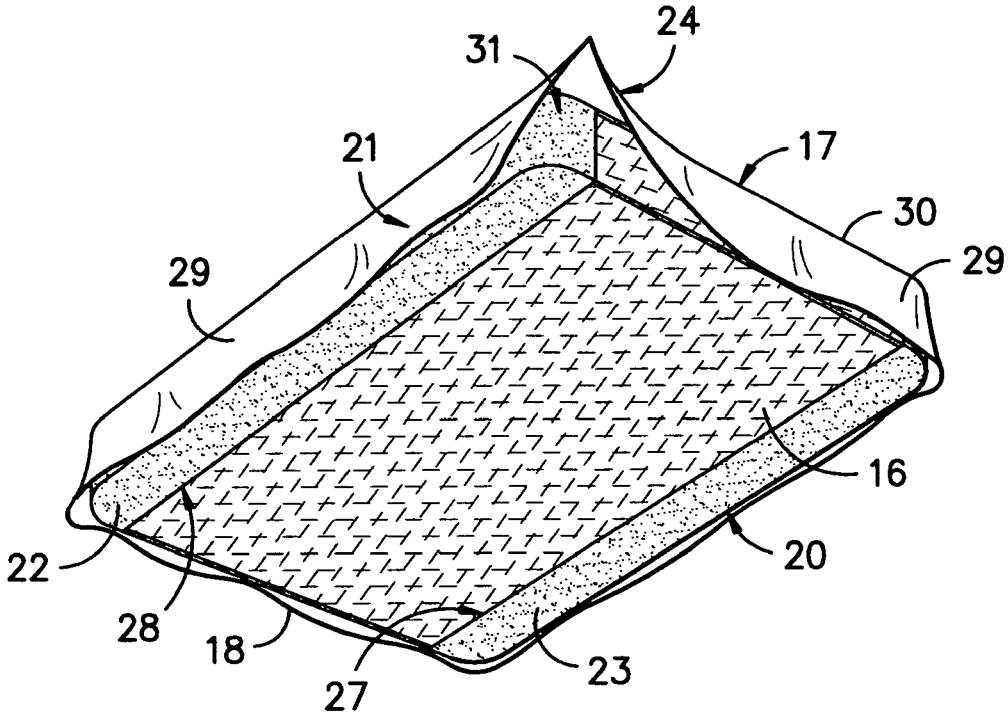
FIG. 6 is a perspective view of the underside of a mattress with the fitted bed covering installed, showing the sides of the mattress inserted in the pockets.

In FIG. 6, the fitted sheet 30 shown if FIG. 5 is installed on mattress 16. Sides 20 and 21 of mattress 16 have been inserted into pockets 27 and 28 of fitted sheet 30, respectively. The drape 29 of upper sheet 24 hangs down around mattress 16 on all sides. Upper sheet 24 is shown lifted at corner 31, revealing panel 22 stretched taut over mattress 16.

Figure 7:
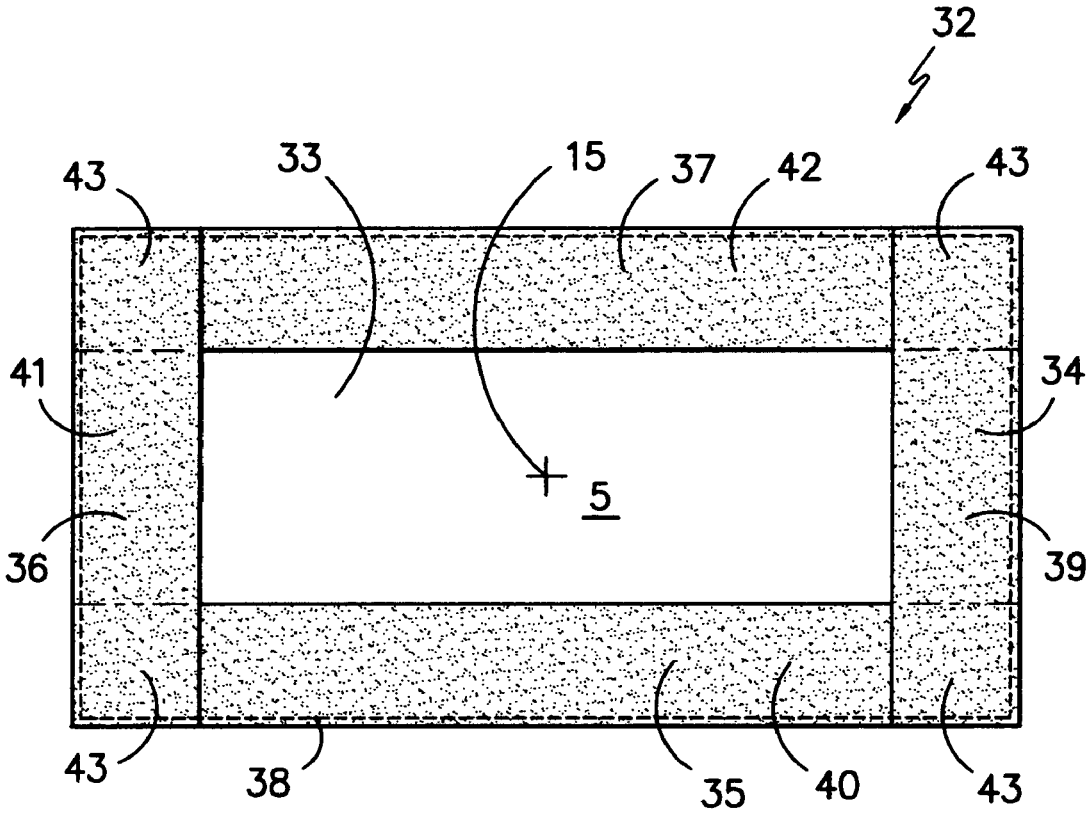
FIG. 7 is a view of the underside of the bed covering having four pockets formed by attaching four panels to the upper sheet.

FIG. 7 shows an embodiment of the fitted bed covering having four pockets. Fitted sheet 32 is constructed from an upper sheet 33, which is substantially the same size as the sleeping surface of a mattress to be covered. Accordingly, upper sheet 33 is not large enough to drape over the sides of a mattress, and rectangular area 5 and the upper sheet 33 are co-extensive, i.e. approximately the same size. Elastic panels 34, 35, 36 and 37 are positioned on the underside of upper sheet 33 and attached thereto by seam 38, thereby creating pockets 39, 40, 41 and 42, with openings directed to the center point 15. It can be seen that adjacent pockets overlap slightly at the inside corners 43 of upper sheet 33.

The fitted bed covering of the present invention is useful in conjunction with a wide variety and type of mattresses. By way of example, the fitted bed covering may be used to cover coil spring mattresses, foam mattresses and futons.

In addition to being economical to manufacture, the fitted bed covering is easy to use. For example, conventional fitted sheets, especially those having inelastic skirts, often shrink during laundering, and require the application of significant force, to pull the sheet over the ends of a mattress. The fitted bed covering of the present invention is easily installed by inserting an end of the mattress, for example, the head of the mattress into a first pocket of the bed covering, and walking around to the other end, to insert the foot of the mattress into a second pocket. The elastic fabric stretches to accommodate the cross section of the mattress, without strain on the part of the individual performing the task. The present invention is particularly useful in hospitals, nursing homes, hotels and dormitories, where changing bed sheets and mattress pads may be a significant portion of an individual's job responsibility, and where back injury and repetitive motion injury becomes a risk.

The invention may be further understood by reference to the following claims.

What I claim is:

1. A fitted bed covering for a mattress, comprising:

(a) an upper sheet having a top side and an underside, the upper sheet incorporating a rectangular area substantially the size of the sleeping surface of the mattress, wherein portions of the rectangular area define a first strip extending along a first side of the rectangular area and a second strip extending along a second side of the rectangular area, wherein the first and second strips are on opposite sides of the rectangular area;

(b) a first elastic, planar panel positioned on the underside of the upper sheet and overlaying the first strip of rectangular area, whereby the first panel and the first strip define parallel planes in contact with each other, wherein the first panel is attached along three of its sides to the first strip of the rectangular area to form a first pocket having an opening towards a center of the rectangular area, wherein one side of the first pocket is comprised of the first strip of the rectangular area and the opposite side of the pocket is comprised of the first panel and the first pocket is capable of stretching to fit over an end of the mattress, the and wherein the depth of the first pocket, as measured perpendicular to the first side of the rectangular area, is greater than a thickness of the mattress and less than one-half of the distance from the first side of the rectangular area to an opposite side; and (c) a second elastic, planar panel positioned on the underside of the upper sheet and overlaying the second strip of the rectangular area, whereby the second panel and the second strip define parallel planes in contact with each other, wherein the second panel is attached along three of its sides to the second strip of the rectangular area to form a second pocket having an opening towards a center of the rectangular area, wherein one side of the second pocket is comprised of the second strip of the rectangular area and the opposite side of the pocket is comprised of the second panel and the second pocket is capable of stretching to fit over an end of the mattress, and wherein the depth of the second pocket, measured perpendicular to the second side of the rectangular area, is greater than a thickness of the mattress and less than one-half of the distance from the second side of the rectangular area to an opposite side.

2. The article of claim 1, wherein the first panel is attached to the upper sheet by a seam extended along the first side of the rectangular panel and along ends of the first strip of the rectangular area, and the second panel is attached to the upper sheet by a seam extended along the second side of the rectangular panel and along ends of the second strip of the rectangular area.

3. The article of claim 2, wherein the first and second panels are each attached along three sides to the upper sheet by sewing or by an adhesive.

4. The article of claim 1, wherein the first and second panels are separate pieces of fabric from the upper sheet, prior to the first and second panels being attached to the upper sheet.

5. The article of claim 4, wherein the upper sheet is a woven fabric constructed of fibers selected from the group consisting of cotton and polyester fibers, and the first and second panels are elastic fabrics.

6. The article of claim 1, wherein the upper sheet is wider than the rectangular area and the width of the first and second strips of the rectangular area, and extends beyond third and fourth sides of the rectangular area for a distance equivalent to or greater than the thickness of the mattress.

7. The article of claim 1, wherein the first and second panels are each a single piece of fabric and are comprised of spandex fiber.

8. The article of claim 1, wherein the first strip of the rectangular area corresponds to a head of the mattress, and the second strip of the rectangular area corresponds to a foot of the mattress.

9. The article of claim 1, wherein the first strip of the rectangular area corresponds to a first side of the mattress, and the second strip of the rectangular area corresponds to a second side of the mattress, which is opposite the first side of the mattress.

10. The article of claim 1, further comprising third and fourth pockets formed by third and fourth elastic panels, respectively, attached to the underside of the upper sheet, along the edges of the rectangular area, wherein the third and fourth pockets are on opposite sides of the rectangular area from each other, and opening toward the center of the rectangular area, and aligned perpendicular to the first and second pockets.

11. A fitted bed covering for a mattress, comprising:

(a) an upper sheet having a top side and an underside, the upper sheet incorporating a rectangular area substantially the size of the sleeping surface of the mattress, wherein portions of the rectangular area define a first strip having a length extending along a first side of the rectangular area and a width abutting the sides of the rectangular area perpendicular to the first side, and a second strip having a length extending along a second side of the rectangular area and a width abutting the sides of the rectangular area perpendicular to the second side, wherein the first and second strips are on opposite sides of the rectangular area;

(b) a first elastic, planar panel, substantially the same size as the first strip of the rectangular area, positioned on the underside of the upper sheet and overlaying the first strip of the rectangular area, wherein the first panel is attached along three of its sides to the first strip of the rectangular area to form a first pocket having an opening towards a center of the rectangular area, wherein one side of the first pocket is comprised of the first strip of the rectangular area and the opposite side of the pocket is comprised of the first panel and the first pocket is capable of stretching to fit over an end of the mattress, and wherein the depth of the first pocket, as measured perpendicular to the first side of the rectangular area, is greater than a thickness of the mattress and less than one-half of the distance from the first side of the rectangular area to an opposite side; and (c) a second elastic, planar panel, substantially the same size as the second strip of the rectangular area, positioned on the underside of the upper sheet and overlaying the second strip of the rectangular area, wherein the second panel is attached along three of its sides to the second strip of the rectangular area to form a second pocket having an opening towards a center of the rectangular area, wherein one side of the second pocket is comprised of the second strip of the rectangular area and the opposite side of the pocket is comprised of the second panel and the second pocket is capable of stretching to fit over an end of the mattress, and wherein the depth of the second pocket, measured perpendicular to the second side of the rectangular area, is greater than a thickness of the mattress and less than one-half of the distance from the second side of the rectangular area to an opposite side.

12. The article of claim 11, wherein the first panel is attached to the upper sheet by a seam extended along the first side of the rectangular panel and along ends of the first strip of the rectangular area, and the second panel is attached to the upper sheet by a seam extended along the second side of the rectangular panel and along ends of the second strip of the rectangular area.

13. The article of claim 12, wherein the first and second panels are each attached along three sides to the upper sheet by sewing or by an adhesive.

14. The article of claim 11, wherein the first and second panels are separate pieces of fabric from the upper sheet, prior to the first and second panels being attached to the upper sheet.

15. The article of claim 14, wherein the upper sheet is a woven fabric constructed of fibers selected from the group consisting of cotton and polyester fibers, and the first and second panels are elastic fabrics that can be stretched over 100% in at least one direction.

16. The article of claim 11, wherein the upper sheet is wider than the rectangular area and the width of the first and second strips of the rectangular area, and extends beyond third and fourth sides of the rectangular area for a distance equivalent to or greater than the thickness of the mattress.

17. The article of claim 11, wherein the first and second panels are each a single piece of fabric and are comprised of spandex fiber.

18. The article of claim 11, wherein the first strip of the rectangular area corresponds to a head of the mattress, and the second strip of the rectangular area corresponds to a foot of the mattress.

19. The article of claim 11, wherein the first pocket has a depth of less than one-fourth of the distance from the first side of the rectangular area to an opposite side, and the second panel has a depth of less than one-fourth of the distance from the second side of the rectangular area to the first side.

20. The article of claim 11, further comprising third and fourth pockets formed by third and fourth elastic panels, respectively, attached to the underside of the upper sheet, along the edges of the rectangular area, wherein the third and fourth pockets are on opposite sides of the rectangular area from each other, and opening toward the center of the rectangular area, and aligned perpendicular to the first and second pockets.

* * * * *